US009698486B2

(12) United States Patent
Shooshtari et al.

(10) Patent No.: US 9,698,486 B2
(45) Date of Patent: Jul. 4, 2017

(54) LOW COMMON MODE RESONANCE MULTIBAND RADIATING ARRAY

(71) Applicant: COMMSCOPE TECHNOLOGIES, LLC, Hickory, NC (US)

(72) Inventors: Alireza Shooshtari, Plano, TX (US); Martin L. Zimmerman, Chicago, IL (US); Peter J. Bisiules, LeGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/768,398

(22) PCT Filed: May 28, 2015

(86) PCT No.: PCT/US2015/033013

§ 371 (c)(1),
(2) Date: Aug. 17, 2015

(87) PCT Pub. No.: WO2016/114810

PCT Pub. Date: Jul. 21, 2016

(65) Prior Publication Data

US 2016/0285169 A1 Sep. 29, 2016

Related U.S. Application Data

(60) Provisional application No. 62/103,799, filed on Jan. 15, 2015.

(51) Int. Cl.
*H01Q 1/50* (2006.01)
*H01Q 9/28* (2006.01)
(Continued)

(52) U.S. Cl.
CPC ..... *H01Q 9/285* (2013.01); *H01Q 1/50* (2013.01); *H01Q 1/521* (2013.01);
(Continued)

(58) Field of Classification Search
CPC ..... H01Q 1/50; H01Q 9/285; H01Q 1/521; H01Q 21/062
(Continued)

(56) References Cited

U.S. PATENT DOCUMENTS 7,173,572 B2 * 2/2007 Teillet ..... H01Q 1/246 343/795
7,405,710 B2 * 7/2008 Bisiules ..... H01P 5/103 343/797
(Continued)

FOREIGN PATENT DOCUMENTS

EP 2736117 5/2014
WO WO 2009/030041 3/2009

OTHER PUBLICATIONS

International Search Report and Written Opinion corresponding to International Patent Application No. PCT/US2015/033013, Date of Mailing: Sep. 9, 2015; 10 pages.

*Primary Examiner* — Huedung Mancuso
(74) *Attorney, Agent, or Firm* — Myers Bigel, P.A.

(57) ABSTRACT

A higher band radiating element for use in a multiband antenna includes first and second dipole arms supported by a feedboard. The feedboard includes first and second matching circuits, each comprising a capacitor-inductor-capacitor (CLC) matching circuit. The matching circuit further includes a CM tuning circuit connecting a portion of the matching circuit to ground via a microstrip trace selected to pass lower band currents while blocking higher band currents. The CM tuning circuit moves the common mode resonance of the higher band support PCB down below the operating frequency of additional, lower band radiating elements present in the multiband antenna, which is preferable to moving the common mode resonance above the lower band frequencies.

19 Claims, 9 Drawing Sheets

(51) Int. Cl.

| | |
|---|---|
| ***H01Q 1/52*** | (2006.01) |
| ***H01Q 21/06*** | (2006.01) |
| *H01Q 1/24* | (2006.01) |
| *H01Q 1/38* | (2006.01) |
| *H01Q 21/26* | (2006.01) |

(52) U.S. Cl.
CPC ..... *H01Q 21/062* (2013.01); *H01Q 1/246* (2013.01); *H01Q 1/38* (2013.01); *H01Q 21/26* (2013.01)

(58) Field of Classification Search
USPC ..... 343/793
See application file for complete search history.

(56) References Cited

U.S. PATENT DOCUMENTS

| | | | | |
|---|---|---|---|---|
| 8,289,218 | B2 * | 10/2012 | Payne | H01Q 9/28 343/725 |
| 9,276,329 | B2 * | 3/2016 | Jones | H01Q 21/30 |
| 2006/0244675 | A1 * | 11/2006 | Elliot | H01P 1/18 343/853 |
| 2009/0122847 | A1 * | 5/2009 | Nysen | H01Q 1/38 375/222 |
| 2010/0271280 | A1 | 10/2010 | Pickles | |
| 2011/0063190 | A1 * | 3/2011 | Ho | H01Q 1/526 343/912 |
| 2014/0139387 | A1 * | 5/2014 | Jones | H01Q 21/30 343/794 |

* cited by examiner

LOW COMMON MODE RESONANCE MULTIBAND RADIATING ARRAY

This application claims priority to and incorporates by reference U.S. Provisional Patent Application No. 62/103,799, filed Jan. 15, 2015 and titled "Low Common Mode Resonance Multiband Radiating Array"

BACKGROUND

Multiband antennas for wireless voice and data communications are known. For example, common frequency bands for GSM services include GSM900 and GSM1800. A low band of frequencies in a multiband antenna may comprise a GSM900 band, which operates at 880-960 MHz. The low band may also include Digital Dividend spectrum, which operates at 790-862 MHz. Further, it may also cover the 700 MHz spectrum at 698-793 MHz. Ultra wide band antennas may cover all of these bands.

A high band of a multiband antenna may comprise a GSM1800 band, which operates in the frequency range of 1710-1880 MHZ. A high band may also include, for example, the UMTS band, which operates at 1920-2170 MHz. Additional bands may comprise LTE2.6, which operates at 2.5-2.7 GHz and WiMax, which operates at 3.4-3.8 GHz. Ultra wide band antennas may cover combinations of these bands.

When a dipole element is employed as a radiating element, it is common to design the dipole so that its first resonant frequency is in the desired frequency band. To achieve this, the dipole arms are about one quarter wavelength, and the two dipole arms together are about one half the wavelength of the desired band. These are commonly known as "half-wave" dipoles.

However, in multiband antennas, the radiation patterns for a lower frequency band can be distorted by resonances that develop in radiating elements that are designed to radiate at a higher frequency band, typically 2 to 3 times higher in frequency. For example, the GSM1800 band is approximately twice the frequency of the GSM900 band.

There are two modes of distortion that are typically seen, Common Mode resonance and Differential Mode resonance Common Mode (CM) resonance occurs when a portion of the higher band radiating element structure resonates as if it were a one quarter wave monopole at low band frequencies. For example, when the higher band radiating element comprises a dipole element coupled to a feed network with an associated matching circuit, the combination of a high band dipole arm and associated matching circuit may resonate at the low band frequency. This may cause undesirable distortion of low band radiating patterns.

For example, low band elements, in the absence of high band elements, may have a half power beam width (HPBW) of approximately 65 degrees. However, when high band elements are combined with low band elements on the same multi-band antenna, Common Mode resonance of the low band signal onto the high band elements may cause an undesirable broadening of the HPBW to 75-80 degrees.

Approaches for reducing CM resonance include adjusting the dimensions of a high band element to move the CM resonance up or down to move it out of band of the low band element. In one example, the high band radiators are effectively shortened in length at low band frequencies by including capacitive elements in the feed, thereby tuning the CM resonance to a higher frequency and out of band. See, for example, U.S. Provisional Application Ser. No. 61/987,791, the disclosure of which is incorporated by reference.

While this approach is cost-effective, tuning the CM resonance above the low band often results in an undesirable broadening of the azimuth beamwidth of the low band pattern.

Another approach for reducing CM resonance is to increase the length of the stalk of a high band element by locating it in a "moat". A hole is cut into the reflector around the vertical stalks of the radiating element. A conductive well is inserted into the hole and the stalk is extended to the bottom of the well. This lengthens the stalk, which lowers the resonance of the CM, allowing it to be moved out of band, while at the same time keeping the dipole arms approximately ¼ wavelength above the reflector. See, U.S. patent application Ser. No. 14/479,102, the disclosure of which is incorporated by reference. While this approach desirably tunes the CM resonance down and below the low band, it requires more space and entails extra complexity and manufacturing cost.

SUMMARY

According to one aspect of the present invention, a higher band radiating element for use in a multiband antenna includes first and second dipole arms supported by a feedboard. Each dipole arm has a capacitive coupling area. The feedboard includes a balun and first and second matching circuits coupled to the balun. The first matching circuit is capacitively coupled to the first dipole arm and the second matching circuit is capacitively coupled to the second dipole arm. The first and second matching circuits each comprise a capacitor-inductor-capacitor (CLC) matching circuit having, in series, a stalk, coupled to the balun, a first capacitive element, an inductor, and a second capacitive element, the second capacitive element being coupled to a dipole arm. The feed circuit further includes a CM tuning circuit connecting the first capacitive element and the inductor to the stalk. The CM tuning circuit may comprise a microstrip line providing a DC connection to the stalk and having a length selected to appear as a high impedance at an operating frequency of the radiating element. The CM tuning circuit moves the common mode resonance of the support PCB down below the operating frequency of additional, lower band radiating elements present in the multiband antenna, which is preferable to moving the common mode resonance above the lower band frequencies. The capacitive elements may be selected to block out-of-band induced currents while passing in-band currents.

The capacitors of the CLC matching circuits may be shared across different components. For example, the first capacitive element and an area of the stalk may provide the parallel plates of a capacitor, and the feedboard PCB substrate may provide the dielectric of the capacitor. The second capacitive element may combine with the capacitive coupling area of the dipole arm to provide the second capacitor.

The radiating element may comprise a cross dipole radiating element. In one example, the multiband antenna comprises a dual band antenna having high band radiating elements and low band radiating elements. The high band radiating elements have a first operational frequency band within a range of about 1710 MHz-2700 MHz, and the low band radiating elements have a second operational frequency band within a range of about 698 MHz-960 MHz. In such an example, the common mode tuning circuit is dimensioned to pass low band current and block high band current.

In another example, a multiband antenna, may include a first array of first radiating elements having a first operational frequency band and a second array of second radiating elements having a second operational frequency band. The second operational frequency band is higher than the first operational frequency band, and often a multiple of the first operational frequency band. The second radiating elements further comprising first and second dipole arms, each dipole arm having a capacitive coupling area, and a feedboard having a balun and first and second matching circuits coupled to the balun. The first matching circuit is coupled to the first dipole arm and the second matching circuit is coupled to the second dipole arm. The first and second matching circuits each include, in series, a stalk, coupled to the balun, a first capacitive element, an inductor, and a second capacitive element, the second capacitive element being associated with one of the first and second dipole arms. Each matching circuit further includes a common mode tuning circuit connecting the first capacitive element and the inductor to the stalk, the common mode tuning circuit comprising a microstrip line dimensional to short any induced low band currents to the stalk without substantially affecting high band currents.

The first operational frequency band comprises a mobile communications low band and the second operational frequency band comprises a mobile communications high band. For example, the first operational frequency band may located within an approximate range of 698 MHz to 960 MHz, and the second operational frequency band may located within an approximate range of 1710 MHz to 2170 MHz.

DESCRIPTION OF THE INVENTION

Figure 1:
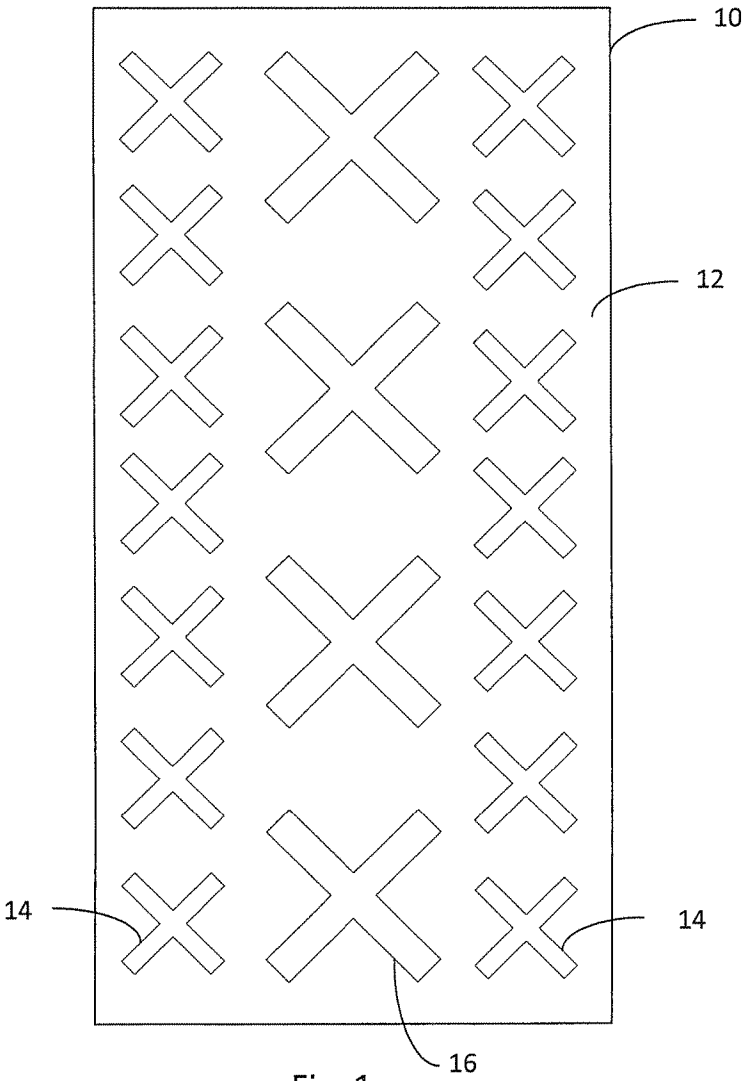
FIG. 1 is a plan view of a panel antenna having arrays of high band radiating elements and low band radiating elements.

FIG. 1 schematically diagrams a dual band antenna 10. The dual band antenna 10 includes a reflector 12, arrays of high band radiating elements 14, and an array of low band radiating elements 16 interspersed with the high band elements. The high band radiating element 14 and low band element 16 may each comprise a cross dipole. Other radiating elements may be used, such as dipole squares, patch elements, single dipoles, etc. The present invention is not limited to dual band antennas, and may be used in any multiband application where higher band radiating elements and lower band radiating elements are present.

Figure 2:
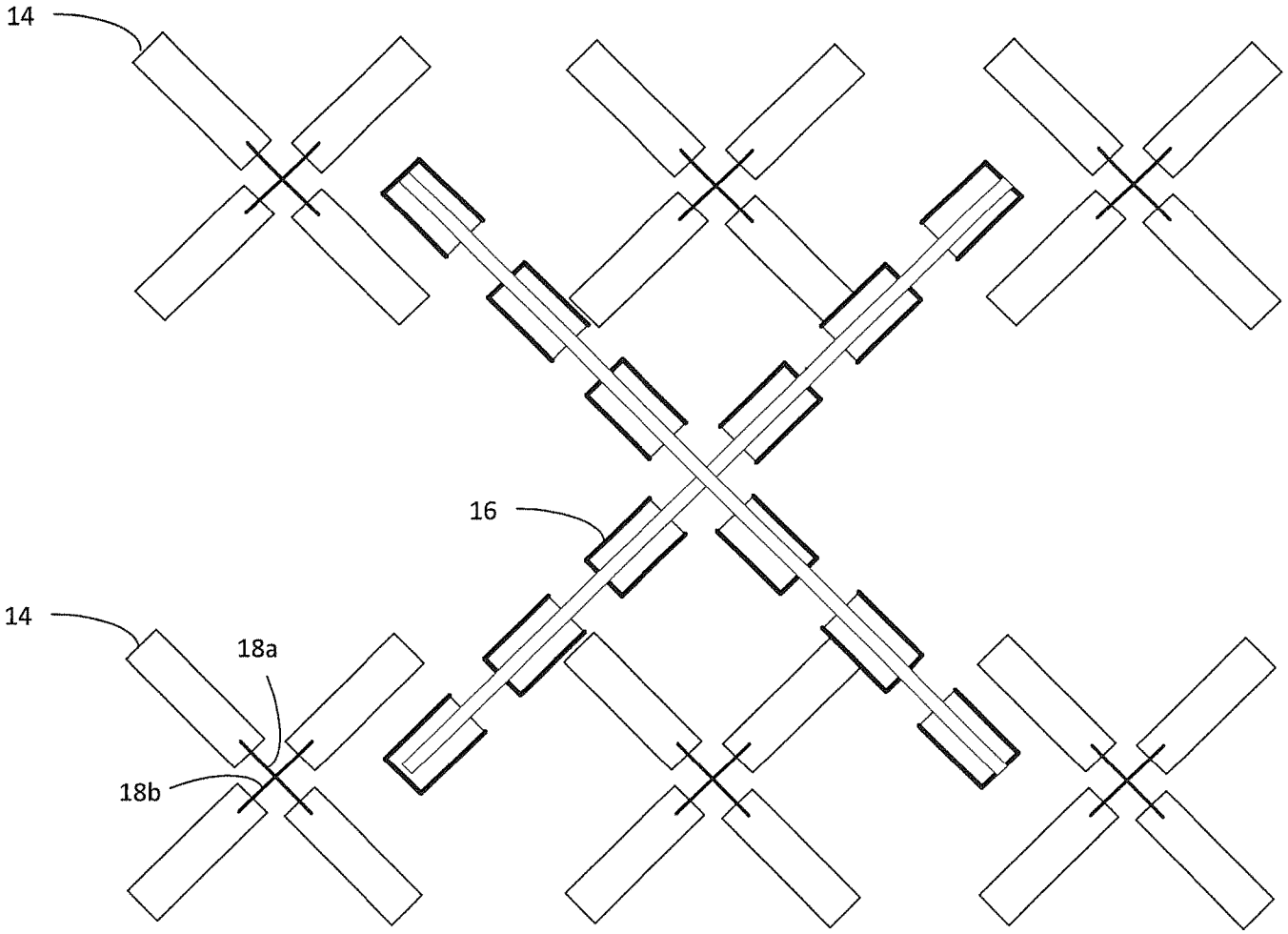
FIG. 2 is a diagram of a low band radiating element and a plurality of high band radiating elements.

FIG. 2 illustrated the dual band antenna of FIG. 1 in more detail. The low band element 16 may optionally include a chokes on the dipole arms 17 to reduce undesirable interference from the low band elements on the high band radiation pattern. See, e.g., PCT/CN2012/087300, which is incorporated by reference. The dipole arms 15 of the high band element 14 may be supported over the reflector 12 by feed boards 18.

Figure 3:
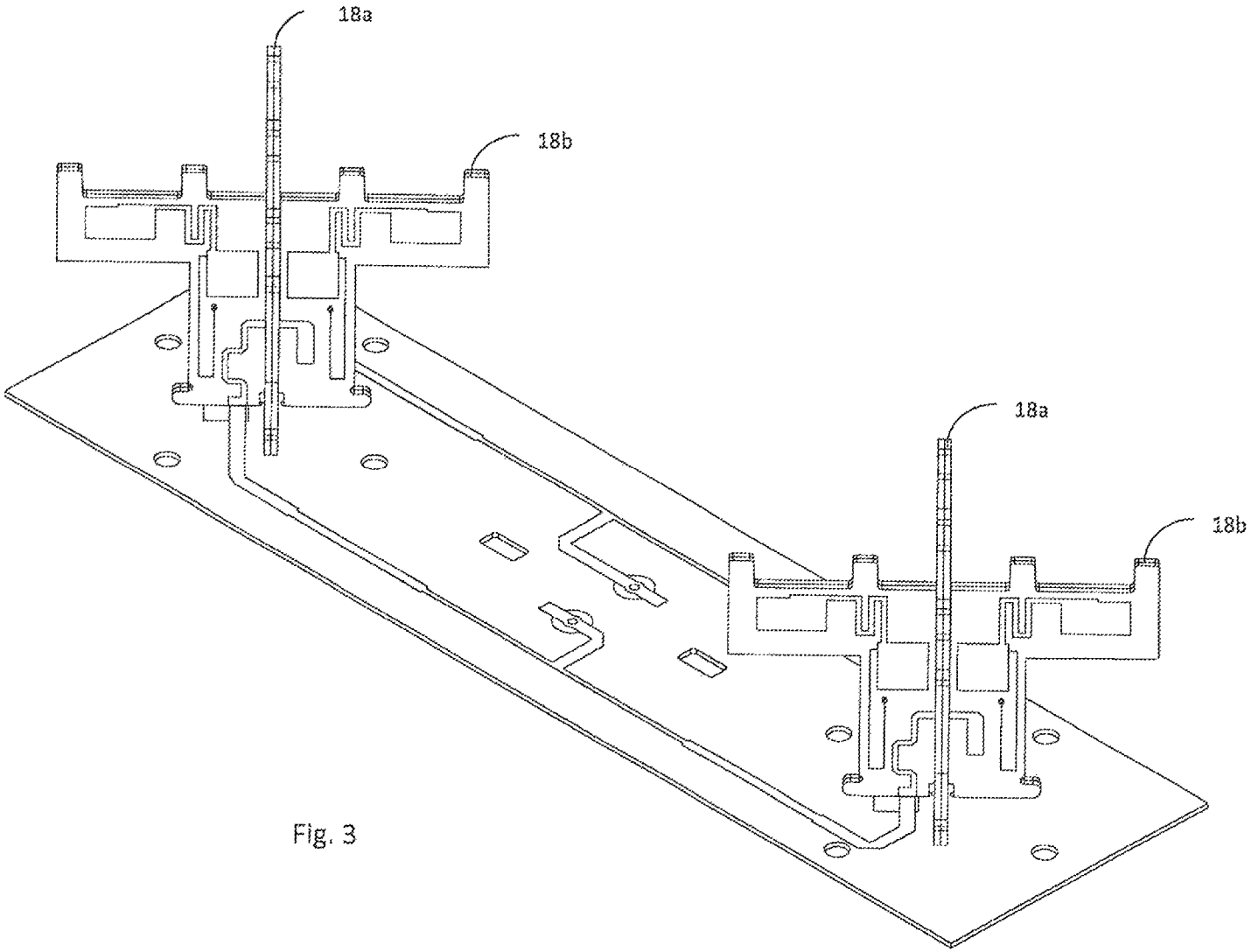
FIG. 3 is an isometric view of a sub-array of high band radiating element feedboards according to one aspect of the present invention.

The high band radiating elements 14 may be arranged in a sub-array. For example, referring to FIG. 3, feed boards 18 are arranged on a backplane with a portion of a feed network to create a sub array.

Figure 4B:
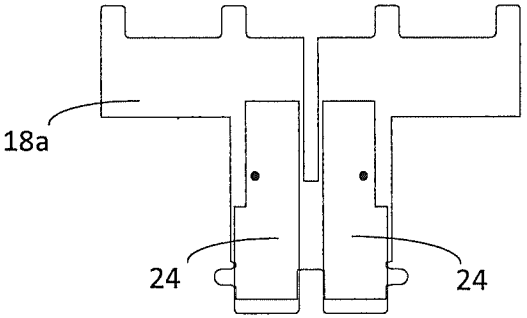
FIGS. 4*a* and 4*b* illustrate one example of layers of metallization according to another aspect of the present invention.
Figure 4A:
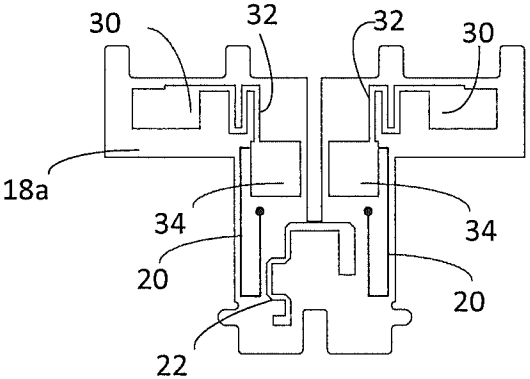

Referring to FIGS. 4*a* and 4*b*, a first example of a feed board 18*a* for a high band radiating element 14 according to one aspect of the present invention is illustrated. In this example, the stalk traces capacitively couple signals from the feed network to the dipole arms of radiating elements 14.

In the example of FIGS. 4*a* and 4*b*, two metallization layers of a feed board 18*a* are illustrated. These metallization layers are on opposite sides of a printed circuit board substrate. A first layer is illustrated in FIG. 4*a* and a second layer is illustrated in FIG. 4*b*. The first layers implements CM tuning circuits 20, hook balun 22, first capacitor sections 34, inductive elements 32, and second capacitor sections 30. The second layer implements stalks 24.

Figure 5B:
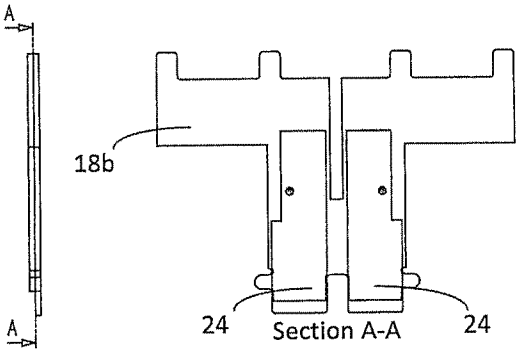
FIGS. 5*a*-5*c* illustrate another example of layers of metallization according to another aspect of the present invention.
Figure 5C:
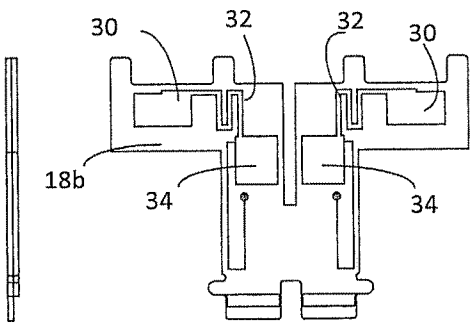
Figure 5A:
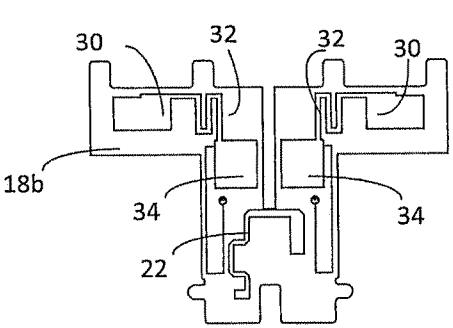

Another example of a feed board including CM tuning circuits 20 is illustrated in FIGS. 5*a*-5*c*. In this example, similar CLC and CM tuning circuits are employed, but are implemented on three layers of metallization. A first outer layer is illustrated in FIG. 5*a*, an inner layer is illustrated in FIG. 5*b*, and a second outer layer is illustrated in FIG. 5*c*. The middle layer implements the stalks 24. The first and second outer layers implement the CM tuning circuits 20, first capacitor sections 34, inductive elements 32, and second capacitor sections 30. Additionally, the first outer layer implements hook balun 22.

Figure 6:
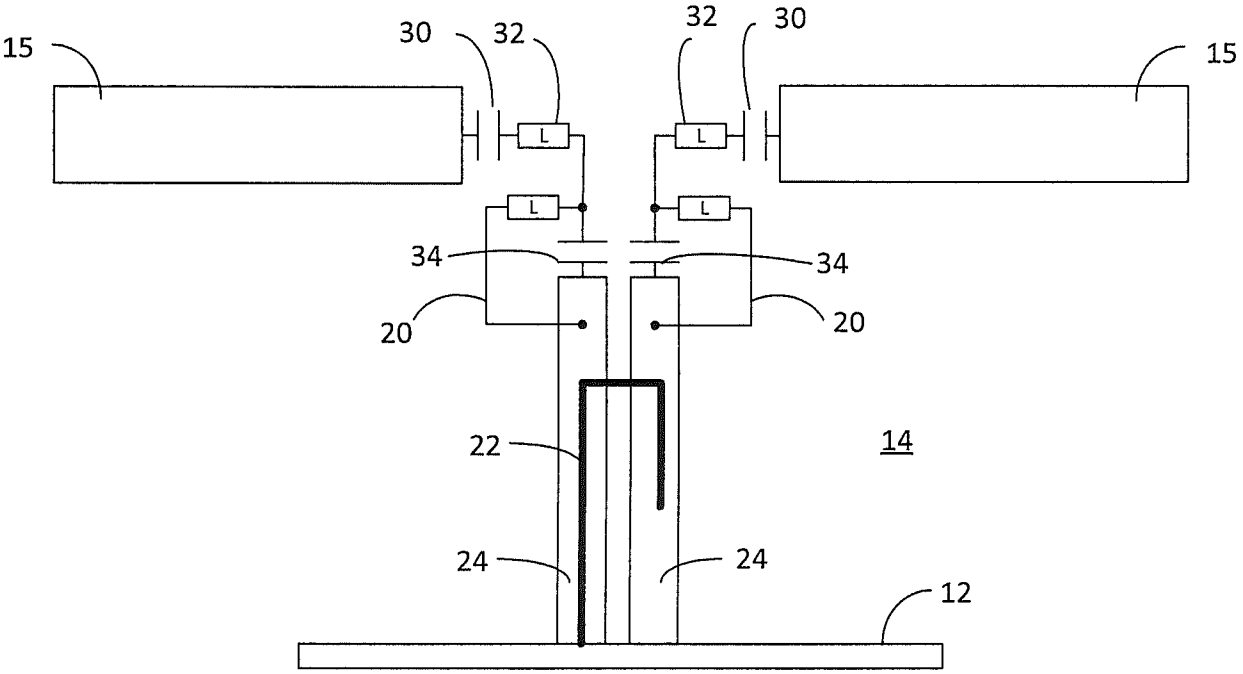
FIG. 6 is a schematic diagram of a radiating element dipole and feed circuit of the elements illustrated in FIGS. 3, 4*a*-4*b*, and 5*a*-5*c*.

A schematic diagram of a high band radiating element 14 according to either of the examples of FIGS. 4*a*-4*b* and FIGS. 5*a*-5*c* is illustrated in FIG. 6. Hook balun 22 couples with stalks 24 through the substrate of feed board 18 to transform a Radio Frequency (RF) signal in transmit direction from single-ended to balanced. (In the receive direction, the balun couples from balanced to unbalanced signals.) Stalks 24 propagate the balanced signals toward the dipole arms 15. First capacitor sections 34 capacitively couple to the stalks 24 through the substrate of feed board 18. Inductive traces 32 connect first capacitor sections 34 to second capacitor sections 30. Second capacitor sections 30 capacitively couple the RF signals to the dipole arms 15. The first capacitor section 34 is introduced to couple capacitively from the stalks 24 to the inductive sections 32 at high band frequencies where the dipole is desired to operate and acts to help block some of the low band currents from getting to the inductor sections 32.

CM tuning circuits 20 provide a direct current (DC) path from first capacitor sections 34 to stalks 24 though a microstrip line and plated through-hole. Because stalks 24 are connected to ground at their lower-most edge, CM tuning circuits 20 provide a DC path to ground. The CM tuning circuits 20, in combination with capacitor sections 34, are preferably configured to act differently at low band and high band frequencies, and to suppress CM resonance at low band frequencies. The impedance of the CM tuning circuits 20 may be adjusted by varying a length and width of the metallic trace, and/or locating the CM tuning circuits over or to the side of a ground plane (e.g., stalk) on an opposite side of a layer of PCB substrate.

For example, CM tuning circuit 20 may comprise a narrow, high impedance microstrip line having length lw. The CM tuning circuit 20 may be dimensioned with a length to appear as a high impedance element at high band RF frequencies where it connects to capacitor section 34 near inductive section 32. However, the electrical length of 20 inversely proportional to frequency, and appears electrically shorter and lower in impedance at low band frequencies where it connects to capacitor section 34. With the addition of CM tuning circuit 20, the main path for any induced low band current is through the CM tuning circuit 20, because the first capacitor section 34 acts as a high impedance at low band frequencies. The narrow, high impedance microstrip may affect the high band CLC match and radiation pattern only at high band wavelengths close to lw=nλ/2, where n may be any integer. The length lw may therefore be selected such that CM tuning circuit 20 does not adversely affect high band signals.

Figure 8:
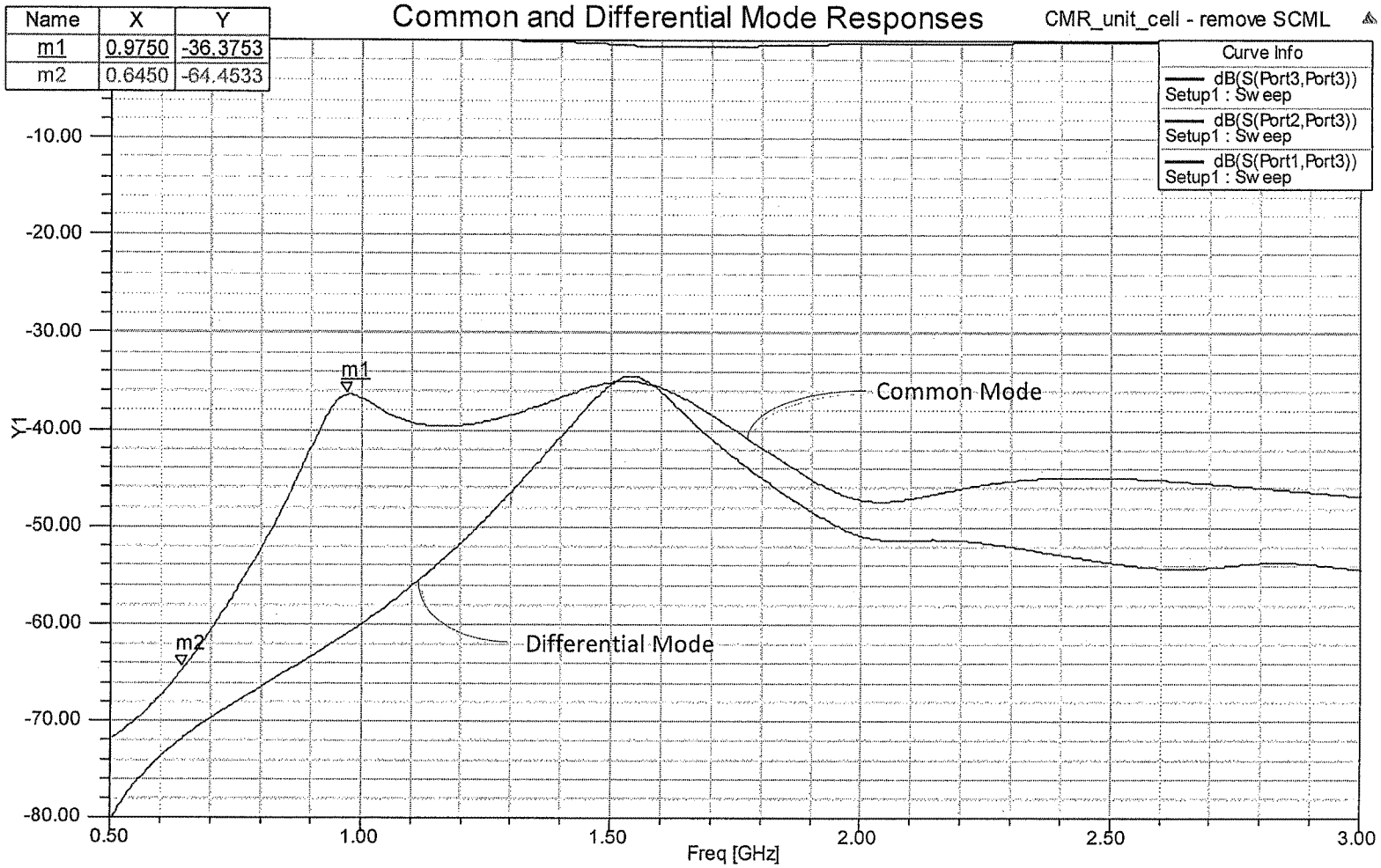
FIG. 8 is a graph illustrating typical common mode and differential mode performance.
Figure 9:
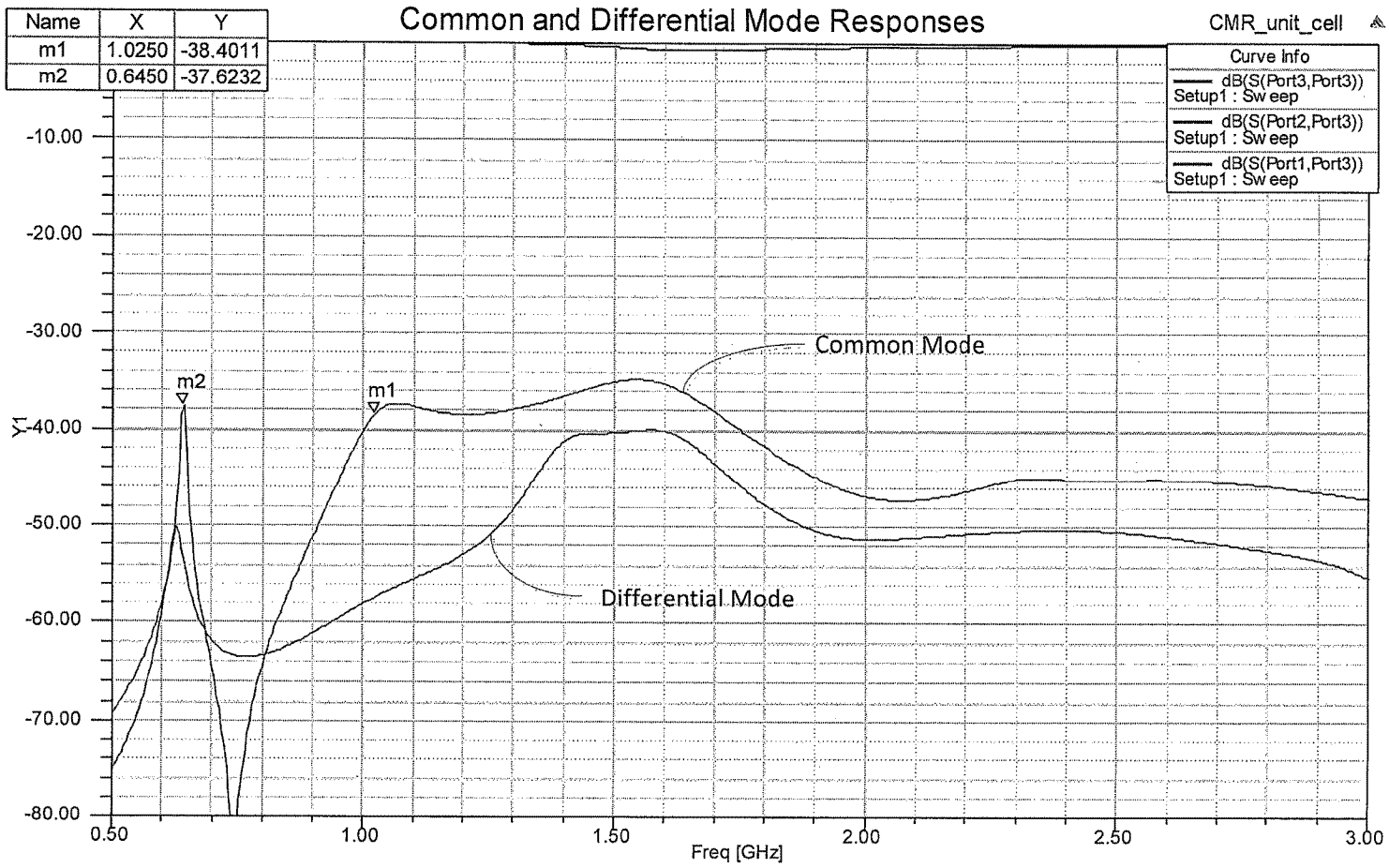
FIG. 9 is a graph illustrating improved common mode and differential mode performance due to the present invention.

Referring to FIG. 8, a plot of CM resonance versus frequency is illustrated. In the case of FIG. 8, the high band radiating element is a dipole with a CLC feed circuit, but no CM tuning circuit 20. There is considerable CM resonance in the band between 790 MHz and 960 MHz. FIG. 9 shows a similar plot of CM resonance, but in this case the high band radiating element is a dipole with a CLC feed circuit and CM tuning circuit 20. CM resonance is considerably reduced at low band frequencies, with a deep notch between 700 MHz and 800 MHz and a CM resonance below 700 MHz.

The CM tuning circuit 20 may be configured to move the CM resonance down below the low band frequency range. The CM resonance of the high band radiating element structure may be shifted by adjusting the length of the CM tuning circuit 20. In particular, the CM resonance may be shifted lower by increasing length lw.

Figure 7:
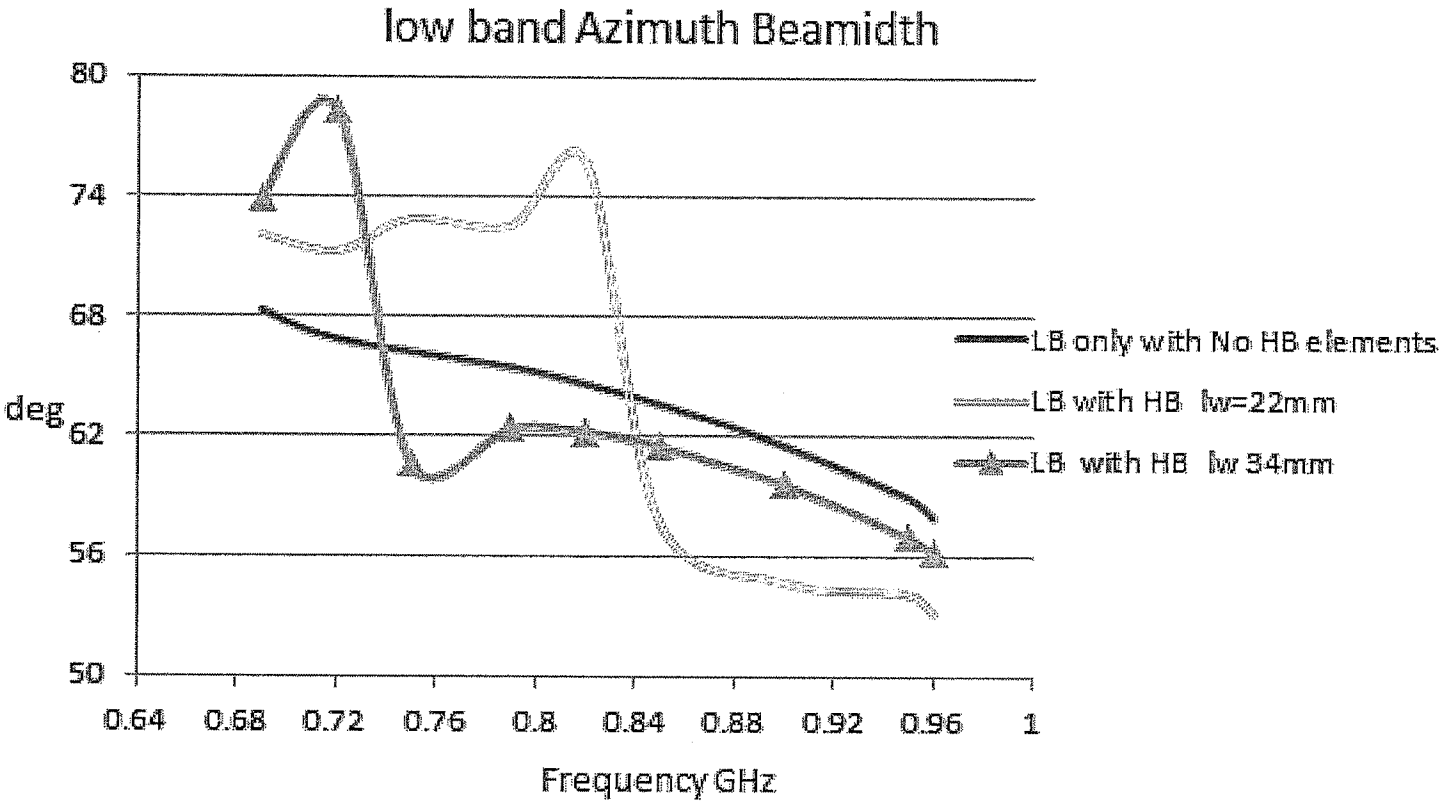
FIG. 7 is a graph showing improved azimuth beamwidth performance due to the present invention.

For example, referring to FIG. 7, three plots of low band beamwidth versus frequency are shown. In a first case, the low band radiating element, in the absence of any high band radiating element, has a beamwidth of 58-65 degrees in at low band frequencies. In a second case, a high band element with a CM tuning circuit 20 having a length lw=22 mm is included. The beamwidth undesirably widens to more than 74 degrees at about 840 MHz, which is within the low band. The widening of the beamwidth is due to the CM resonance in the high band radiating element. This in-band CM resonance may also cause additional beam pattern distortions, such as large azimuth beam squint and poor Front/Back ratios. Also, in this second case, the beamwidth is much better above the CM resonance frequency (less than 60 degrees) than below the CM resonance frequency (more than 70 degrees), illustrating the benefit of tuning the CM resonance frequency to down below the low band.

In a third case, a high band element with a CM tuning circuit 20 having a length lw=34 mm is included. In this case, the CM resonance is indicated where the beamwidth widens to almost 80 degrees, which is at about 720 MHz. This is well below 760 MHz, which is outside the lower end of the low band frequency range. Advantageously, the beamwidth of the low band radiating elements is about 62 degrees, which is an improvement over techniques that tune the CM resonance frequency to be above the low band range, and the HB radiators of the present invention do not require expensive and bulky moats. A length lw=34 mm also has very little effect on the high band pattern and impedance matching. Other lengths for lw may also be utilized. For example, a length lw=65 mm moves the CM resonance down to 640 MHz.

In another example of the present invention, the place where the CM tuning circuit 20 connects to the feed stalk may be varied to move CM resonance lower and out of band without detuning the high band radiating element. This solution is advantageous when a desired length lw of the CM tuning circuit 20 degrades or detunes the high band dipole. For example, applying the equation lw=nλ/2, a length lw=65 mm (as in the above example) may affect high band CLC match and radiation pattern at 2300 MHz. If 2300 MHz is within the operational band of the high band element, a different length 1*w* may be selected to achieve good higher band performance. Significantly, the high band impedance of CM tuning circuit 20 depends solely on length lw, whereas the common mode responds is dependent on the total length of the signal path from second capacitor section 30 to stalk 24. Accordingly, the CM tuning circuit 20 attachment point may be adjusted closer to or further away from the second capacitor section 30 to adjust overall length of the CM tuning circuit 20 and to move the CM resonance back to the desired frequency.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

What is claimed is:

1. A higher band radiating element for a multiband antenna having at least higher band elements and lower band elements, comprising:

a. first and second dipole arms, each dipole arm having a capacitive coupling area; and b. a feedboard having a balun and first and second matching circuits coupled to the balun, the first matching circuit being coupled to the first dipole arm and the second matching circuit being coupled to the second dipole arm, the first and second matching circuits each comprising in series:

1. a stalk, coupled to the balun,
2. a first capacitive element;
3. an inductor; and
4. a second capacitive element, the second capacitive element being coupled to a dipole arm;

each matching circuit further comprising a common mode tuning circuit connecting the first capacitive element and the inductor to the stalk to move the common mode resonance of the matching circuits to a frequency below the lower band frequency.

2. The higher band radiating element of claim 1, wherein the common mode tuning circuit further comprises a microstrip line providing a DC connection to the stalk and having a length selected such that it appears as a high impedance at an operating frequency of the higher band radiating element.

3. The higher band radiating element of claim 2, wherein the common mode tuning circuit has a length selected such that it appears as a relatively low impedance at the operating frequency of the lower band radiating element.

4. The higher band radiating element of claim 1, wherein the first capacitive element and an area of the stalk comprise parallel plates of a capacitor and the feedboard substrate comprises a dielectric of a capacitor.

5. The higher band radiating element of claim 1, wherein the second capacitive element and dipole arm capacitive coupling area combine to form a capacitor that blocks out of band currents.

6. The higher band radiating element of claim 1, wherein the radiating element further comprises a cross dipole radiating element.

7. The higher band radiating element of claim 1, wherein the higher band radiating element further comprises a high band radiating element of a dual-band array.

8. The higher band radiating element of claim 1, wherein the higher band radiating element has a first operational frequency band within a range of about 1710 MHz-2700 MHz, and each lower band radiating element has a second operational frequency band within a range of about 698 MHz-960 MHz.

9. The radiating element of claim 8, wherein the common mode tuning circuit has a length selected to pass low band current and block high band current.

10. The higher band radiating element of claim 1, wherein the common mode tuning circuit has a length such that it does not de-tune the higher band radiating element.

11. The multiband antenna of claim 10, wherein the first operational frequency band comprises a mobile communications low band and the second operational frequency band comprises a mobile communications high band.

12. The multiband antenna of claim 10, wherein the first operational frequency band is located within an approximate range of 698 MHz to 960 MHz, and the second operational frequency band is located within an approximate range of 1710 MHz to 2170 MHz.

13. A multiband antenna, comprising:

a. a first array of first radiating elements having a first operational frequency band; and b. a second array of second radiating elements having a second operational frequency band, the second operational frequency band being higher than the first operational frequency band, the second radiating elements further comprising: a. first and second dipole arms, each dipole arm having a capacitive coupling area; and b. a feedboard having a balun and first and second matching circuits coupled to the balun, the first matching circuit being coupled to the first dipole arm and the second matching circuit being coupled to the second dipole arm, the first and second matching circuits each comprising in series:

1. a stalk, coupled to the balun,
2. a first capacitive element;
3. an inductor; and
4. a second capacitive element, the second capacitive element being associated with one of the first and second dipole arms, each matching circuit further comprising a common mode tuning circuit connecting the first capacitive element and the inductor to the stalk, the common mode tuning circuit comprising a microstrip line dimensioned to short any induced low band currents to the stalk without substantially affecting high band currents, thereby moving common mode resonance down below the second operational frequency band.

14. A higher band radiating element for a multiband antenna having at least higher band elements and lower band elements, comprising:

a first dipole arm;

a second dipole arm;

a feedboard having a balun and first and second matching circuits coupled to the balun, the first matching circuit being coupled to the first dipole arm and the second matching circuit being coupled to the second dipole arm, the first matching circuit comprising a first stalk that is coupled to the balun and a first capacitor coupled between the first stalk and the first dipole arm, and the second matching circuit comprising a second stalk that is coupled to the balun and a second capacitor coupled between the second stalk and the second dipole arm, wherein the first matching circuit further comprises a common mode tuning circuit that provides a direct current path from a first node that is between the first capacitor and the first dipole arm to ground.

15. The higher band radiating element of claim 14, wherein the first matching circuit further includes a third capacitor coupled in series between the first capacitor and the first dipole arm, wherein the first node is located between the first and third capacitors.

16. The higher band radiating element of claim 14, wherein the common mode tuning circuit comprises a transmission line connecting the first node to the stalk, and wherein a length of the transmission line is selected such that it appears as a high impedance at an operating frequency of the higher band radiating element.

17. The higher band radiating element of claim 16, wherein the length of the transmission line is further selected such that it appears as a relatively low impedance at the operating frequency of the lower band radiating element.

18. The higher band radiating element of claim 14, wherein the first matching circuit is further configured to move the common mode resonance of the matching circuits to a frequency below the operating frequency of the lower band radiating element.

19. The higher band radiating element of claim 15, wherein the first matching circuit further includes a first inductor in series between the first capacitor and the third capacitor and a second inductor in series between the second capacitor and the fourth capacitor.

* * * * *